United States Patent [19]

Lentsch et al.

[11] Patent Number: 4,846,993

[45] Date of Patent: Jul. 11, 1989

[54] ZERO PHOSPHATE WAREWASHING DETERGENT COMPOSITION

[75] Inventors: Steven E. Lentsch, St. Paul; Thomas R. Oakes, Stillwater, both of Minn.

[73] Assignee: Ecolab Inc., St. Paul, Minn.

[21] Appl. No.: 217,378

[22] Filed: Jul. 11, 1988

[51] Int. Cl.[4] ..... C11D 3/36; C11D 3/37; C11D 3/395

[52] U.S. Cl. ..... 252/95; 252/174.16; 252/174.24; 252/DIG. 14; 252/DIG. 17; 134/42

[58] Field of Search ..... 252/94, 95, 156, 174.16, 252/174.24, 180, DIG. 11, DIG. 14, DIG. 17; 210/687, 699; 134/42

[56] References Cited

U.S. PATENT DOCUMENTS

| | | | |
|---|---|---|---|
| 3,297,578 | 1/1967 | Crutchfield et al. | 252/99 |
| 3,890,228 | 6/1975 | Hwa et al. | 210/699 |
| 3,899,436 | 8/1975 | Copeland et al. | 252/99 |
| 3,959,167 | 5/1976 | Hwa et al. | 252/180 |
| 4,127,483 | 11/1978 | Smith | 210/699 |
| 4,127,496 | 11/1978 | Stokes | 252/102 |
| 4,163,732 | 8/1979 | Sai et al. | 252/99 |
| 4,187,190 | 2/1980 | McLaughlin et al. | 252/99 |
| 4,233,172 | 11/1980 | McLaughlin et al. | 252/99 |
| 4,372,870 | 2/1983 | Snyder et al. | 252/180 |
| 4,539,144 | 9/1985 | de Ridder et al. | 252/526 |
| 4,556,493 | 12/1985 | Cuisia | 210/699 |
| 4,563,284 | 1/1986 | Amjad | 210/699 |
| 4,576,722 | 3/1986 | Gaylor et al. | 210/699 |
| 4,579,676 | 4/1986 | Bull | 252/94 |
| 4,581,145 | 4/1986 | Cuisia et al. | 210/699 |
| 4,608,188 | 8/1986 | Parker et al. | 252/99 |
| 4,631,131 | 12/1986 | Cuisa et al. | 210/697 |
| 4,652,377 | 3/1987 | Amjad | 210/699 |
| 4,680,124 | 7/1987 | Young et al. | 210/697 |

FOREIGN PATENT DOCUMENTS 1117395 2/1982 Canada .

OTHER PUBLICATIONS

Detergency Theory and Test Methods Part III, edited by W. G. Cutler & R. C. Davis, Whirlpool Corporation, Marcel Dekker, Inc., 1980

*Primary Examiner*—Prince E. Willis

*Attorney, Agent, or Firm*—Merchant, Gould, Smith, Edell, Welter & Schmidt

[57] ABSTRACT

A warewashing detergent composition with an improved builder system having zero phosphate that conditions service water by holding or suspending divalent or trivalent hardness ions in solution and by preventing precipitation of the hardness ions beyond their stoichiometric concentration. The composition comprises a source of alkalinity, a water-conditioning vinyl polymer with pendant —$CO_2H$ groups, a soil-dispersing phosphinopolycarboxylic acid, and a water-conditioning organic phosphonate.

42 Claims, No Drawings

ZERO PHOSPHATE WAREWASHING DETERGENT COMPOSITION

FIELD OF THE INVENTION

The invention pertains to a machine warewashing detergent composition, having a zero phosphate content, that contains an improved builder system. More specifically, the builder system of the warewashing detergent can treat divalent or trivalent hardness ions in service water and can, at the same time, prevent precipitation of the hardness ions beyond a stoichiometric concentration with respect to the builder system by a threshold effect.

BACKGROUND OF THE INVENTION

In recent years, much attention has been given to the components of warewashing detergents that treat and reduce the harmful effects of water hardness. Hardness ions are typically undesirable in conjunction with warewashing detergents since they interfere with the soil removal mechanism. Hardness ions typically comprise metal ions such as calcium, magnesium, iron, manganese, and other typically divalent or trivalent metal cations depending on the source of service water used in the warewashing environment.

Machine warewashing detergents are commonly highly alkaline, often providing wash water with a pH of 10.0 to 11.5, and are usually formulated by mixing or otherwise combining a variety of known organic and inorganic ingredients, such as alkaline detergent salts and alkaline condensed phosphates. Halogen-releasing agents also can be used in formulating warewashing detergents to provide stain removal and sanitization.

Condensed phosphates, such as sodium tripolyphosphate, have been used in the past as builders because of their detergency benefits and because of their water-treating properties. These benefits include soil dispersion, the sequestration of calcium, magnesium and other hardness ions, prevention of precipitation of calcium carbonate and magnesium hydroxide through a threshold effect, and chlorine stability. However, phosphates have been identified as contributing to water eutrophication, a process of excess algae growth in natural water. Many state governments have found it desirable to cause detergent makers to replace phosphates, particularly sodium tripolyphosphate, in warewashing and other detergents.

A significant problem has arisen in the search for a builder or builder system that is not a source of phosphate but provides all the detergency and water-treatment benefits of sodium tripolyphosphate. Many builders and combinations of builders have been evaluated in the past, but none have found commercial success in the warewash market. This is largely a result of the failure of these builders to provide one or more of the benefits of sodium tripolyphosphate.

It is recognized in the art that a threshold effect is desirable for use in a warewash machine. See U.S. Pat. No. 3,899,436. The threshold effect prevents precipitation of hard water metal ions at a concentration of ion in excess of the stoichiometric concentration of the sequestering agent. This is one reason why straight sequestering builders, such as ethylene diamine tetraacetic acid (EDTA) or zeolites, have not found commercial success. Detergents based on sodium tripolyphosphate sequester and rely on the threshold effect.

U.S. Pat. No. 4,579,676 discloses a liquid cleaning composition having a low phosphate content comprising an alkali metal hydroxide, a source of active chlorine, a water conditioning acrylic polymer, and a phosphinopolycarboxylic acid. The composition is particularly useful in cleaned-in-place equipment employed in the food processing industry.

U.S. Pat. No. 4,680,124 discloses a method of preventing the formation of calcium polyacrylate scale on industrial heat transfer surfaces such as boilers. The boiler water is treated with a water soluble phosphonate such as 1-hydroxyethylidene-1,1-diphosphonic acid. The warewashing environment of the present invention has a much higher pH than the boiler environment so scale is more difficult to control.

U.S. Pat. No. 4,539,144 discloses a machine dishwashing composition having a very low or zero phosphate content comprising an alkaline detergent material, a nonionic detergent surfactant, a water soluble calcium sequestering agent, and a hydrolyzed polymaleic anhydride.

U.S. Pat. No. 4,127,496 discloses a non-phosphate dishwasher detergent composition comprising an organic non-phosphate sequestering agent such as ethylenediamine tetraacetate or nitrilotriacetate, a nonionic detergent, a dry water-soluble anti-spotting agent, and non-phosphate alkaline and neutral builder salts.

U.S. Pat. No. 4,563,284, U.S. Pat. No. 4,581,145, U.K. Patent Application GB No. 2,137,185A, and Canadian Patent No. 1,117,395, all teach non-warewashing processes using a combination of monomer threshold agents and polymer dispersing agents to prevent calcium precipitation of the individual ingredients. While these systems obtain some value in either sequestration scale prevention or threshold performance, none provide the spectrum of properties needed in the replacement of condensed phosphates in machine warewashing.

A substantial need exists to provide a builder system for a warewashing detergent without intentionally added phosphate or polyphosphate that has all the detergency benefits of sodium tripolyphosphate or other condensed phosphate without its associated environmental harm.

SUMMARY OF THE INVENTION

The invention is an improved warewashing detergent having a zero phosphate content that contains an improved builder system. The builder system acts as a water softening agent for service water by holding or suspending divalent or trivalent hardness ions in solution and by preventing precipitation of the hardness ions beyond their stoichiometric concentration with respect to the builder system by a threshold effect. The builder system also acts as a soil-dispersing agent.

The builder system comprises blended polymers comprising a vinyl polymer having pendant carboxyl groups and a water soluble phosphinopolycarboxylic acid polymer, combined with a monomeric organic phosphonate threshold agent. The builder system is combined with a source of alkalinity to form the warewashing detergent composition. These phosphorous-containing polymers are not believed to be a source of phosphate or condensed phosphate to service waters. We have found that the builder system of the invention is a water conditioner in a warewashing environment and also provides the detergency benefits of sodium tripolyphosphate.

DETAILED DESCRIPTION OF THE INVENTION

The invention resides in an improved warewashing detergent composition having a zero phosphate content that contains an improved builder system. The halogen-stable builder system acts as a water-conditioning and soil-dispersing agent. The builder system has the ability to soften service water by holding or suspending divalent or trivalent hardness ions, such as calcium and magnesium ions, in solution. A threshold mechanism is used by the builder system to prevent precipitation of hardness ions beyond a stoichiometric concentration. The builder system comprises polymer water-conditioning and soil-dispersing components, and a monomer threshold component.

The polymer water-conditioning component is an effective amount of a water-soluble vinyl polymer having pendant carboxyl groups, which can act to condition wash solutions under end-use conditions. This polymer is a polymeric material having an average molecular weight of between about 500 and about 15,000 and having in its molecular structure the group derived from an alpha beta unsaturated mono- or dicarboxylic acid or anhydride:

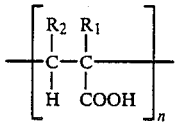

optionally together with the group derived from a comonomer:

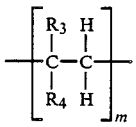

in which $R_1$ is hydrogen, or a hydroxyl group; $R_2$ is hydrogen, an alkyl or alkoxy group having from 1 to 4 carbon atoms, or a carboxylic acid group; $R_3$ is hydrogen or an alkyl group having 1 to 4 carbon atoms; and $R_4$ is a hydroxyl group, an alkyl group having 1 to 4 carbon atoms; an alkoxy group having 1 to 4 carbon atoms, an aldehyde group, or a carboxylic acid group. A preferred polymer in this group is a hydrolyzed polymaleic anhydride.

Another polymer that can be used in the invention is a water-soluble acrylic polymer. Such polymers include polyacrylic acid, polymethacrylic acid, acrylic acidmethacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrile methacrylonitrile copolymers, or mixtures thereof. Water-soluble salts or partial salts of these polymers, such as the respective alkali metal (e.g., sodium, potassium) or ammonium salts can also be used. The weight average molecular weight of the polymers is from about 500 to about 15,000 and is preferably within the range of from about 750 to about 10,000. Preferred polymers include polyacrylic acid, the partial sodium salt of polyacrylic acid or sodium polyacrylate having molecular weights of about 1,000 to about 6,000. These polymers are commercially available and methods for their preparation are well-known in the art.

For example, commercially-available water-conditioning polyacrylate solutions useful in the present invention include the sodium polyacrylate solution, Colloid® 207 (Colloids, Inc., Newark, N. J.); the polyacrylate acid solution, Aquatreat® AR-602-A (Alco Chemical Corp., Chattanooga, Tenn.); the polyacrylic acid solutions (50–65% solids) and the sodium polyacrylate powders (M. W. 2,100 and 6,000); and solutions (45% solids) available as the Goodright® K-700 series from B. F. Goodrich Co.; and the sodium or partial sodium salts of polyacrylic acid solutions (M. W. 1000–4,500), available as the ACRYSOL® series from Rohm and Haas. A specifically preferred polyacrylate useful in the invention is under the trade name ACRYSOL LMW-45, having a molecular weight of about 4,500.

The soil-dispersing component comprises an effective amount of a water-soluble phosphinopolycarboxylic acid polymer having a molecular weight of about 200–5,000, and is preferably within the range of from about 250–3,000. This component, which may also be referred to as a "phosphinoacrylic polymer," is formally the condensation product of low molecular weight, unsaturated monomers, such as those used to form the acrylic polymers described above, with sodium hypophosphite.

For example, acrylic acid-based polymers have the general formula:

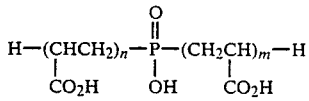

wherein the molecular weight and ratio of propionic acid units to the:

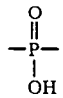

unit may be varied over a wide range. For example, n plus m may vary from about 3–4 to about 70–75. Commercially-available phosphinopolycarboxylic acids having weight ratios of total polyacrylic acid to phosphinoxy of from about 33:1 to 35:1 and molecular weights of about 200–5,000, preferably about 250–3,000, are useful in the invention.

An especially preferred material is the phosphinopolycarboxylic acid available as BELSPERSE® 161 from Ciba-Geigy as a 46–52% aqueous solution (M. W. about 1,200). The BELSPERSE® 161 acts as a soil-dispersing agent as pointed out in U.S. Pat. No. 4,579,676. Phosphinopolycarboxylic acid is also chlorine stable, alkali stable, and hydrolytically stable.

The monomer threshold component of the invention can comprise any water-conditioning organic phosphonate. The organo-phosphonic acid compounds are those having a carbon-to-phosphorus bond as shown in the following general formula:

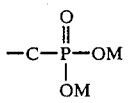

Compounds within the scope of the above description generally are included in one of at least two categories expressed by the following general formulas:

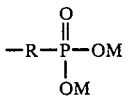

wherein R is a lower alkyl having from about 1 to 6 carbon atoms, e.g., methyl, ethyl, butyl, propyl, isopropyl, pentyl, isopentyl, and hexyl; substituted lower alkyl of from 1 to 6 carbon atoms, e.g., hydroxyl and amino-substituted alkyls; a mononuclear aromatic (aryl) radical, e.g., phenyl, benzene, etc., or a substituted mononuclear aromatic compound, e.g., hydroxyl, amino, lower alkyl-substituted aromatic, e.g., benzyl phosphonic acid; and M is a water-soluble cation, e.g., sodium, potassium, ammonium, lithium, etc., or hydrogen. Specific examples of compounds encompassed by the above formula include: methylphosphonic acid, ethylphosphonic acid, 2-hydroxyethylphosphonic acid, 2-amino-ethylphosphonic acid, isopropylphosphonic acid, benzene phosphonic acid, benzyl phosphonic acid, and 2-phosphono-butane-tricarboxylic acid-1,2,4.

Another general formula for organic phosphonate is:

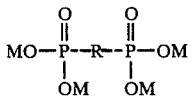

wherein R is an alkylene having from about 1 to about 12 carbon atoms or a substituted alkylene having from about 1 to about 12 carbon atoms, e.g., hydroxyl, amino, etc., substituted alkylenes, and M is the same as defined above. Specific examples of compounds encompassed by this formula include methylene diphosphonic acid, ethylidene diphosphonic acid, isopropylidene diphosphonic acid, 1-hydroxyethylidene-1,1-diphosphonic acid, hexamethylene diphosphonic acid, trimethylene diphosphonic acid, decamethylene diphosphonic acid, 1-hydroxy propylidene diphosphonic acid, 1,6-dihydroxy, 1,6-dimethyl, hexamethylene diphosphonic acid, dihydroxy, diethyl ethylene diphosphonic acid.

Another general formula for organic phosphonate useful in the present invention is:

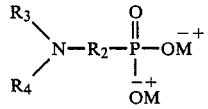

wherein $R_2$ is a lower alkylene having from about 1 to about carbon atoms, or an amine or hydroxy-substituted lower alkylene; $R_3$ is $[R_2\text{-}PO_3M_2]H$, OH, amino, substituted amino, an alkyl having from 1 to 6 carbon atoms, a substituted alkyl of from 1 to 6 carbon atoms (e.g., OH, $NH_2$ substituted) a mononuclear aromatic radical and a substituted mononuclear aromatic radical (e.g., OH, $NH_2$ substituted); $R_4$ is $R_3$ or the group represented by the formula:

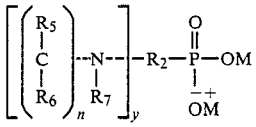

wherein $R_5$ and $R_6$ are each hydrogen, lower alkyl of from about 1 to 6 carbon atoms, a substituted lower alkyl (e.g., OH, $NH_2$ substituted), hydrogen, hydroxyl, amino group, substituted amino group, a mononuclear aromatic radical (e.g., OH and amine substituted); $R_7$ is $R_5$, $R_6$, or the group $R_2$—$PO_3M_2$ ($R_2$ is as defined above); n is a number of from 1 through about 15; y is a number of from about 1 through about 14; and M is as earlier defined.

Specific examples of compounds encompassed by this formula include: Amino tri (methylene phosphonic acid), ethylene diamine tetra (methylene phosphonic acid), hexamethylene diamine tetra (methylene phosphonic acid), diethylene triamine penta (methylene phosphonic acid), and ethanolamine N,N-di-(methylene phosphonic acid).

A specifically-preferred organic phosphonate is 1-hydroxyethylidene-1,1-diphosphonic acid. This is commercially available as Dequest 2010. This particular phosphonate acts primarily as a threshold agent toward calcium carbonate, but also prevents precipitation of calcium polyacrylate, and acts as a sequestering agent of calcium and magnesium ions. It is also hydrolytically and chlorine stable.

Therefore, the builder system of the present invention comprises about 1–40%, preferably about 2-9%, of a water-conditioning vinyl polymer, preferably an acrylic polymer, about 0.3–14%, preferably about 0.7–3%, of a water-soluble phosphinopolycarboxylic acid, and about 0.5–18%, preferably about 0.9–4%, of a water-conditioning organic phosphonate. The preferred embodiment of the invention is to use builder components in a weight ratio of about 0.5–3:1 acrylic polymer to organic phosphonate, and a ratio of about 0.1–1.5:1 phosphinopolycarboxylic acid to organic phosphonate. The most preferred builder components of the invention are sodium polyacrylate, phosphinopolycarboxylic acid, and 1-hydroxyethylidene-1,1-diphosphonic acid. This combination of builders has not been used before to provide all the detergency benefits of sodium tripolyphosphate without the accompanying environmental harms.

The builder system has the ability to hold or suspend hardness ions in solution, functioning as a water conditioner primarily by the threshold mechanism. This means that less than stoichiometric amounts of builder components are required to prevent precipitation of hardness ions beyond the microcrystal stage. We have found that the combination of phosphinopolycarboxylic acid, sodium polyacrylate, and organic phosphonate produces an improved threshold effect that prevents precipitation of magnesium hydroxide. Furthermore, the builder system is alkali, chlorine, and hydrolitically stable and does not revert to orthophosphate.

The above builder system is combined with a source of alkalinity and an effective amount of soft water to form a warewashing detergent composition, having water-softening and precipitation-preventing characteristics, but having a zero phosphate content. By the term "zero phosphate," we mean the absence of significant amounts of $PO^3{}_4$ anion, or condensed phosphates thereof, which are intentionally added to the detergent composition of the invention. Minor concentrations of phosphate may be present as a result of impurity or other non-intentional addition. The warewashing invention can contain other phosphorous species.

The source of alkalinity is selected from the group consisting of alkali metal hydroxides, such as sodium hydroxide, potassium hydroxide, or mixtures of each thereof. Alkali metal silicates, such as sodium metasilicate, may also be used. The preferred form, which is the most cost-effective, is commercially available sodium hydroxide, which can be obtained in aqueous solutions at a concentration of about 50 wt-% and in a variety of solid forms of varying particle sizes. The sodium hydroxide can be employed in either the liquid or solid form (powdered, beads, or pellets), or a mixture of both.

For some cleaning operations, it may be desirable to add minor but effective amounts of alkali-stable synthetic organic surfactants, which may be selected from any of the known surfactant classes, which are water-miscible and chemically-compatible. Preferred for use in the present invention are nonionic surfactants used as defoamers and emulsifiers for warewashing purposes. These are known to those skilled in the art.

The detergent composition of the invention can also contain a source of available chlorine which acts as a biocidal or destaining agent. Both organic and inorganic sources of available chlorine are useful, including alkali metal and alkaline earth metal hypochlorite, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate dihydrate, 1,3-dichloro-5,5-dimethylhydantoin, N-chlorosulfamide, Chloramine T, Dichloramine T, Chloramine B, and Dichloramine B.

For use in cast solid, powder, or granulated form, the preferred source of available chlorine is sodium dichloroisocyanurate dihydrate, either encapsulated or as purchased.

For use in liquids, gels, or mulls, the preferred sources of available chlorine include sodium, potassium or lithium hypochlorite and mono- and dibasic calcium hypochlorite, for reasons of availability, stability, and highly effective disinfectant action. Other optional ingredients may also be added to the detergent composition such as a defoamer, dye, perfume, neutral salts to act as process aids, and thickeners.

The detergent composition of the invention may be made in any physical form, such as a cast solid, powder, granulates, an aqueous liquid, a gel, or a mull.

Thus, the warewashing detergent composition of the present invention comprises about 5–75%, preferably about 20–60%, of a source of alkalinity, about 1–40%, preferably about 2–9%, of a water-conditioning vinyl polymer with pendant —$CO_2H$ groups, having a molecular weight of about 500–15,000, preferably about 1,000–6,000, about 0.3–14%, preferably about 0.7–3%, of phosphinopolycarboxylic acid having a molecular weight of 200–5,000, preferably about 250–3,000, and about 0.5–18%, preferably about 0.9–4% of an organic phosphonate.

A preferred source of alkalinity would be about 30–50% of sodium hydroxide beads and 10–30% of 50 wt-% aqueous sodium hydroxide. The preferred vinyl polymer is sodium polyacrylate, and the preferred organic phosphonate is 1-hydroxyethylidene-1,1-diphosphonic acid. The detergent composition further comprises about 5–75% of distilled water and about 1–5% of nonionic surfactant. About 5–20% of sodium chloride or sodium sulfate is in the composition when a solid detergent is desired. About 1–15% of an active chlorine source can be added to the composition to act as a destaining agent.

The present invention is particularly suited for use in machine warewashing. The service water in the machine dissolves the detergent composition to form an aqueous wash solution that is contacted with a soiled surface of a ware at a temperature of about 50–75° C. for a period of time effective to clean the soiled surface.

The invention will be further described by reference to the following detailed examples and test results which includes a best mode.

EXAMPLES I–VI

The following detergent examples were prepared by mixing the ingredients in the order listed in Table I. When ingredients 5 and 7 are added, a considerable amount of heat of neutralization and dissolution is generated, so no additional heating is required. Upon cooling, the compositions solidify.

Examples I and II contain all three builder components. Examples III, IV, and V contain less than three components and Example VI is a phosphate-containing detergent.

TABLE I

| | | Example (Final Wt.-% Active Ingredient) | | | | | |
|---|---|---|---|---|---|---|---|
| | INGREDIENT | I | II | III | IV | V | VI |
| 1. | Soft Water | 13.47 | 8.30 | 11.50 | 17.50 | 14.8 | 3.00 |
| 2. | Sodium Polyacrylate (50%) | 9.00 | 11.65 | 15.50 | — | 11.65 | — |
| 3. | Phosphinopolycarboxylate (Belsperse ®161) | 3.00 | 3.00 | — | — | 3.00 | — |
| 4. | 1-hydroxyethylidene-1,1-diphosphonic acid (Dequest 2010) | 3.33 | 3.30 | 3.30 | 3.30 | — | — |
| 5. | NaOH 50% | 20.00 | 17.35 | 16.50 | 20.00 | 17.35 | 20.10 |
| 6. | Nonionic Surfactant | 1.20 | 1.20 | 1.20 | 1.20 | 1.20 | 1.20 |
| 7. | NaOH Bead | 40.00 | 40.00 | 40.00 | 40.00 | 40.00 | 39.00 |
| 8. | Sodium Sulfate | 10.00 | — | — | — | 12.00 | — |
| 9. | Sodium Chloride | — | 7.50 | 12.00 | 18.00 | — | — |
| 10. | Solid Chlorine Source | — | 7.50 | — | — | — | — |
| 11. | Sodium Tripolyphosphate | — | — | — | — | — | 30.90 |
| 12. | Phosphate ester defoamer | — | — | — | — | — | 0.10 |
| 13. | Polyacrylic acid (50%) | — | — | — | — | — | 5.00 |
| 14. | Inert Material | — | — | — | — | — | 1.50 |

WATER CONDITIONING TEST

A water-conditioning test was carried out using different combinations of the builder components of the invention at various concentrations and at different pHs to determine their effectiveness at preventing crystal growth.

EXPERIMENTAL PROCEDURE

A. SAMPLE PREPARATION

The procedure is first to mix the following in the order listed to 100 ml of test solution in a stoppered test bottle.

1. Well water (about 98.0 ml).
2. Builders expressed in ppm of active.
3. Sodium carbonate expressed in ppm.
4. Adjust pH upward to either 10 5 or 11 5 with dilute sodium hydroxide solution.

B. AGING PROCEDURE

The stoppered test bottle are placed into a water bath and held at 70° C. for two hours.

C. METAL ANALYSIS

At the end of the two hours, the test bottles are removed from the water bath and a portion immediately filtered through a 0.45 micron filter. The filtrate is evaluated for calcium (Ca), magnesium (Mg), and sodium (Na) using an Inductively Coupled Argon Plasma (ICAP) instrument.

An untreated well water blank is also subjected to ICAP to determine the initial concentration of calcium and magnesium. Results are expressed in ppm.

D. RESULTS

The results of the water-conditioning test are listed in Tables II–V.

TABLE II

| Detergent Use Conc. 1500 ppm; Init. pH = 10.5 FILTRATE (0.45 u) | | | | | | | | |
|---|---|---|---|---|---|---|---|---|
| Test No. | Deq. 2010 PPM | LMW 45 PPM | Belsp. 161 PPM | Carbonate PPM | Ca PPM | Mg PPM | Na PPM | pH After 2 Hours @70° C. |
| 57 | 30.0 | — | — | 400 | 28.5 | 6.1 | 303 | 10.6 |
| 58 | 30.0 | — | — | 400 | 28.7 | 5.8 | 313 | 10.7 |
| 59 | — | 67.5 | — | 400 | 17.9 | 19.2 | 290 | 10.7 |
| 60 | — | 67.5 | — | 400 | 56.7 | 20.3 | 331 | 9.7 |
| 61 | — | — | 22.5 | 400 | 5.9 | 3.9 | 276 | 10.5 |
| 62 | — | — | 22.5 | 400 | 6.6 | 4.8 | 245 | 10.5 |
| 63 | 30.0 | 67.5 | — | 400 | 58.4 | 21.8 | 299 | 10.6 |
| 64 | 30.0 | 67.5 | — | 400 | 59.6 | 22.0 | 297 | 10.65 |
| 65 | 30.0 | — | 22.5 | 400 | 48.7 | 18.8 | 308 | 10.3 |
| 66 | 30.0 | — | 22.5 | 400 | 29.4 | 8.2 | 263 | 10.45 |
| 67 | — | 67.5 | 22.5 | 400 | 58.7 | 21.3 | 276 | 10.4 |
| 68 | — | 67.5 | 22.5 | 400 | 58.3 | 22.2 | 263 | 10.5 |
| 69 | 30.0 | 67.5 | 22.5 | 400 | 58.3 | 21.2 | 297 | 10.55 |
| 70 | 30.0 | 67.5 | 22.5 | 400 | 58.6 | 22.1 | 275 | 10.5 |

TABLE III

| Detergent Use Conc. 1500 ppm; Init. pH = 11.5 FILTRATE (0.45 u) | | | | | | | | |
|---|---|---|---|---|---|---|---|---|
| Test No. | Deq. 2010 PPM | LMW 45 PPM | Belsp. 161 PPM | Carbonate PPM | Ca PPM | Mg PPM | Na PPM | pH After 2 Hours @70° C. |
| 71 | 30.0 | — | — | 400 | 26.0 | 3.1 | 342 | 11.15 |
| 72 | 30.0 | — | — | 400 | 25.2 | 2.5 | 352 | 11.15 |
| 73 | — | 67.5 | — | 400 | 9.8 | 19.6 | 372 | 11.25 |
| 74 | — | 67.5 | — | 400 | 10.2 | 20.0 | 388 | 11.15 |
| 75 | — | — | 22.5 | 400 | 2.4 | 2.1 | 345 | 11.2 |
| 76 | — | — | 22.5 | 400 | 2.2 | 5.3 | 370 | 11.45 |
| 77 | 30.0 | 67.5 | — | 400 | 30.2 | 3.1 | 322 | 11.25 |
| 78 | 30.0 | 67.5 | — | 400 | 31.0 | 2.9 | 351 | 11.35 |
| 79 | 30.0 | — | 22.5 | 400 | 24.3 | 2.2 | 363 | 11.3 |
| 80 | 30.0 | — | 22.5 | 400 | 22.9 | 1.5 | 343 | 11.35 |
| 81 | — | 67.5 | 22.5 | 400 | 12.4 | 19.5 | 356 | 11.4 |
| 82 | — | 67.5 | 22.5 | 400 | 13.2 | 20.5 | 359 | 11.4 |

TABLE III-continued

| Detergent Use Conc. 1500 ppm; Init. pH = 11.5 FILTRATE (0.45 u) | | | | | | | | |
|---|---|---|---|---|---|---|---|---|
| Test No. | Deq. 2010 PPM | LMW 45 PPM | Belsp. 161 PPM | Carbonate PPM | Ca PPM | Mg PPM | Na PPM | pH After 2 Hours @70° C. |
| 83 | 30.0 | 67.5 | 22.5 | 400 | 54.7 | 19.5 | 358 | 11.2 |
| 84 | 30.0 | 67.5 | 22.5 | 400 | 52.9 | 18.6 | 377 | 11.4 |
| Well Water Blank | | | | | 61.8 | 22.4 | 3.5 | |

TABLE IV

| Detergent Use Conc. 2000 ppm; Init. pH = 10.5 FILTRATE (0.45 u) | | | | | | | |
|---|---|---|---|---|---|---|---|
| Test No. | Deq. 2010 PPM | LMW 45 PPM | Belsp. 161 PPM | Carbonate PPM | Ca PPM | Mg PPM | Na PPM |
| 85 | 40.0 | — | — | 400 | 42.9 | 16.6 | 334 |
| 86 | 40.0 | — | — | 400 | 28.3 | 10.8 | 304 |
| 87 | — | 90.0 | — | 400 | 62.1 | 21.5 | 347 |
| 88 | — | 90.0 | — | 400 | 62.7 | 20.3 | 277 |
| 89 | — | — | 30.0 | 400 | 62.7 | 21.8 | 299 |
| 90 | — | — | 30.0 | 400 | 27.8 | 17.6 | 249 |
| 91 | 40.0 | 90.0 | — | 400 | 57.3 | 20.7 | 293 |
| 92 | 40.0 | 90.0 | — | 400 | 57.2 | 20.6 | 286 |
| 93 | 40.0 | — | 30.0 | 400 | 39.3 | 15.6 | 263 |
| 94 | 40.0 | — | 30.0 | 400 | 39.6 | 15.1 | 257 |
| 95 | — | 90.0 | 30.0 | 400 | 57.2 | 20.2 | 364 |
| 96 | — | 90.0 | 30.0 | 400 | 58.1 | 20.2 | 258 |
| 97 | 40.0 | 90.0 | 30.0 | 400 | 57.7 | 20.6 | 290 |
| 98 | 40.0 | 90.0 | 30.0 | 400 | 58.3 | 20.9 | 285 |

TABLE V

| Detergent Use Conc. 2000 ppm; Init. pH = 11.5 FILTRATE (0.45 u) | | | | | | | |
|---|---|---|---|---|---|---|---|
| Test No. | Deq. 2010 PPM | LMW 45 PPM | Belsp. 161 PPM | Carbonate PPM | Ca PPM | Mg PPM | Na PPM |
| 99 | 40.0 | — | — | 400 | 26.5 | 3.1 | 356 |
| 100 | 40.0 | — | — | 400 | 26.9 | 3.1 | 361 |
| 101 | — | 90.0 | — | 400 | 12.1 | 19.4 | 372 |
| 102 | — | 90.0 | — | 400 | 13.0 | 19.3 | 355 |
| 103 | — | — | 30.0 | 400 | 4.2 | 1.8 | 334 |
| 104 | — | — | 30.0 | 400 | 3.8 | 1.5 | 352 |
| 105 | 40.0 | 90.0 | — | 400 | 57.2 | 20.4 | 365 |
| 106 | 40.0 | 90.0 | — | 400 | 56.5 | 20.2 | 413 |
| 107 | 40.0 | — | 30.0 | 400 | 27.8 | 1.9 | 370 |
| 108 | 40.0 | — | 30.0 | 400 | 27.3 | 2.4 | 356 |
| 109 | — | 90.0 | 30.0 | 400 | 17.8 | 20.6 | 368 |
| 110 | — | 90.0 | 30.0 | 400 | 15.8 | 20.6 | 380 |
| 111 | 40.0 | 90.0 | 30.0 | 400 | 57.2 | 20.5 | 386 |
| 112 | 40.0 | 90.0 | 30.0 | 400 | 57.0 | 20.5 | 429 |
| Well Water Blank | | | | | 61.9 | 22.4 | 1 |

E. DISCUSSION OF RESULTS

The experimental procedure involves filtration through a 0.45 micron filter. Thus, it is not known whether the calcium and magnesium that pass through the filter do so as the free ions or as small crystallites.

The results show that a combination of a monomer (Dequest 2010) and an acrylate polymer (LMW-45) do a reasonable job of conditioning water hardness. Runs 105 and 106 (Table V) have 57.2 and 56.5 ppm of calcium and 20.4 and 20.2 ppm of magnesium in the filtrate, versus 61.9 and 22.4 ppm of calcium and magnesium in the well water blank, respectively. Neither the monomer nor the acrylate polymer alone does as well as the combination according to this test procedure, as shown in runs 99–102. The combination of a monomer, acrylate polymer and phosphinopolycarboxylic acid (Belsperse® 161) also conditions water hardness as shown in runs 111 and 112. (See also runs 69 and 70 of Table II, runs 83 and 84 of Table III, and runs 97 and 98 of Table IV.)

The amount of hardness minerals in the well water is equivalent to 246.8 ppm. It is apparent to those skilled in the art that the total amount of builder is not sufficient to completely sequester the hardness, so some of the conditioning is due to the threshold mechanism.

Although this data shows that combinations of builders condition water hardness, it does not necessarily mean that a good dishwashing result can be predicted. For example, those skilled in the art know that EDTA completely sequesters water hardness, but it has not found commercial success.

MACHINE LIMING TEST

A test to determine whether water hardness minerals will deposit onto a warewash machine or onto tableware is the Machine Liming test.

The Machine Liming Test is useful because it demonstrates whether the conditioned water hardness has any tendency to adhere to the machine or to tableware. It does not matter if the water-hardness minerals are kept in solution as ions or agglomerate to small crystallites, as long as the builder system prevents the minerals from depositing.

EXPERIMENTAL PROCEDURE

A. PREPARATION AND PROCEDURE

The machine used for the test is a Hobart C-44 single-rack conveyor machine. It is fitted with a detergent-dispensing system that maintains 2000 ppm detergent. Hot well water (15 grains per gallon hardness) is fed continuously into the machine at a rate of 7.5 liters per minute. In addition, beef stew/tomato sauce puree is fed into the wash tank at a rate of 8 ml per minute. The wash tank temperature is maintained at 155°-160° F. The test is carried out for two hours. At the end of the test, the interior of the machine is observed for evidence of film or deposit on the heater coils and all other parts. Results are graded as shown in Table VI.

TABLE VI

MACHINE LIMING TEST GRADING SCALE

| Grade | Condition |
|---|---|
| 0.0 | No lime or film on heater coils or machine parts. |
| 1.0 | Small amount of lime film on heater coils, none elsewhere. |
| 2.0 | Slight film on machine interior and heater coils. |
| 3.0 | Film on machine interior and build-up on heater coils. |
| 4.0 | Build-up on both machine interior and heater coils. |
| 5.0 | Heavy precipitate on machine interior and heater coils. |

B. RESULTS

The Machine Limiting Test was performed on Examples I-VI of Table I, and the results are listed in Table VII.

TABLE VII

MACHINE LIMING RESULTS

| Example | Grade |
|---|---|
| I | 1.0 |
| II | 1.0 |
| III | 2.0 |
| IV | 3.5 |
| V | 5.0 |
| VI | 3.0 |

C. DISCUSSION OF RESULTS

Table VII shows that the instant invention outperforms conventional phosphated dishwash detergent. When the phosphonate (Dequest 2010) was not used in the detergent formulation (Example V), a heavy calcium polyacrylate precipitate was formed during the liming test. As can be seen from the above table, the formula that worked the best included all three of the builder components of the present invention.

The detergent composition of Example II was also tested and evaluated in the field with institutional warewashers using local city water. Good results were achieved when 2,000 ppm of detergent was used in the warewasher.

While the invention has been described and fully explained in the detailed description of the specification and preferred embodiments, many embodiments of the invention can be made without departing from the spirit and scope of the invention.

We claim:

1. A builder system for machine warewashing that conditions service water by holding or suspending divalent or trivalent hardness ions in solution and by preventing precipitation of the hardness ions beyond their stoichiometric concentration, comprising:

(a) an effective amount of a polymer water-conditioning agent comprising a vinyl polymer with pendant $-CO_2H$ groups having a molecular weight of 500-15,000;

(b) an effective amount of a polymer soil-dispersing agent comprising a phosphinopolycarboxylic acid; and (c) an effective amount of a monomer threshold agent comprising a water-conditioning organic phosphonate.

2. The builder system of claim 1 wherein said vinyl polymer comprises about 1-40% of an acrylic polymer having a molecular weight of about 750-10,000.

3. The builder system of claim 2 wherein said acrylic polymer comprises sodium polyacrylate, polyacrylic acid, or the partial sodium salt of polyacrylic acid.

4. The builder system of claim 1 wherein said phosphinopolycarboxylic acid is present in the builder system at a concentration of about 0.3-14% and has a molecular weight of about 200-5,000.

5. The builder system of claim 1 wherein said organic phosphonate is present in the builder system at a concentration of about 0.5-18%.

6. The builder system of claim 5 wherein said organic phosphonate is 1-hydroxyethylidene-1,1-diphosphonic acid.

7. The builder system of claim 1 wherein said system has a zero phosphate content.

8. A builder system for machine warewashing that conditions service water by holding or suspending divalent or trivalent hardness ions in solution and by preventing precipitation of the hardness ions beyond their stoichiometric concentration, comprising:

(a) about 2–9% of an acrylic polymer comprising polyacrylic acid, the partial sodium salt of polyacrylic acid or sodium polyacrylate having a molecular weight of about 1,000–6,000;
(b) about 0.7–3% of a phosphinopolycarboxylic acid having a molecular weight of about 250–3,000; and
(c) about 0.9–4% of an organic phosphonate comprising 1-hydroxyethylidene-1,1-diphosphonic acid.

9. The builder system of claim 8 wherein said acrylic polymer and said organic phosphonate are in a weight ratio of about 0.5–3:1, and said phosphinopolycarboxylic acid and said organic phosphonate are in a weight ratio of about 0.1–1.5:1.

10. A warewashing detergent composition that conditions service water by holding or suspending divalent or trivalent hardness ions in solution and by preventing precipitation of the hardness ions beyond their stoichiometric concentration, comprising:
(a) about 5–75% of a source-of alkalinity;
(b) about 1–40% of a water-conditioning agent comprising a vinyl polymer with pendant-$CO_2H$ groups,
having a molecular weight of about 500–15,000;
(c) about 0.3–14% of a polymer soil-dispersing agent comprising a phosphinopolycarboxylic acid having a molecular weight of about 200–5,000; and
(d) about 0.5–18% of a monomer threshold agent comprising a water-conditioning organic phosphonate.

11. The detergent composition of claim 10 wherein said composition is in cast solid, powder, or granulated form.

12. The detergent composition of claim 10 wherein said composition is an aqueous liquid, gel, or mull.

13. The detergent composition of claim 10 wherein said source of alkalinity comprises alkali metal hydroxides or alkali metal silicates.

14. The detergent composition of claim 13 wherein said alkali metal hydroxide comprises sodium hydroxide, potassium hydroxide, or mixtures thereof.

15. The detergent composition of claim 13 wherein said alkali metal silicate comprises sodium metasilicate.

16. The detergent composition of claim 14 wherein said sodium hydroxide comprises about 30–50% of sodium hydroxide beads and 10–30% of 0.50 wt-% aqueous sodium hydroxide.

17. The detergent composition of claim 10 wherein said vinyl polymer comprises acrylic polymers or polymaleic anhydrides.

18. The detergent composition of claim 17 wherein said acrylic polymers comprise sodium polyacrylate, polyacrylic acid, the partial sodium salt of polyacrylic acid, or mixtures thereof, having a molecular weight of about 750–10,000.

19. The detergent composition of claim 10 wherein said organic phosphonate is 1-hydroxyethylidene-1,1-diphosphonic acid.

20. The detergent composition of claim 10 wherein said composition has a zero phosphate content.

21. The detergent composition of claim 10 further comprising:
(a) about 5–75% of distilled water; and
(b) about 1–5% of a nonionic surfactant.

22. The detergent composition of claim 10 further comprising about 5–20% sodium chloride or sodium sulfate.

23. The detergent composition of claim 10 further comprising about 1–15% of a active chlorine source.

24. The detergent composition of claim 23 wherein said chlorine source comprises sodium hypochlorite, calcium hypochlorite, or sodium dichlorisocyanurate dihydrate.

25. A warewashing detergent composition having a zero phosphate content that conditions service water by holding or suspending divalent or trivalent hardness ions in solution and by preventing precipitation of the hardness ions beyond their stoichiometric concentration, comprising:
(a) about 20–60% of an alkali metal hydroxide comprising sodium hydroxide, potassium hydroxide, or mixtures thereof;
(b) about 2–9% of an acrylic polymer comprising polyacrylic acid, the partial sodium salt of polyacrylic acid or sodium polyacrylate having a molecular weight of about 1,000–6,000;
(c) about 0.7–3% of a phosphinopolycarboxylic acid having a molecular weight of about 250–3000; and
(d) about 0.9–4% of an organic phosphonate comprising 1-hydroxyethylidene-1,1-diphosphonic acid.

26. A warewashing process for cleaning a soiled surface using a detergent composition that conditions service water by holding or suspending divalent or trivalent hardness ions in solution and by preventing precipitation of the hardness ions beyond their stoichiometric concentration, comprising:
(a) dissolving in water an effective amount of said detergent composition, thereby forming an aqueous wash solution, said detergent composition comprising:
(1) about 5–75% of a source of alkalinity;
(2) about 1–40% of a water-conditioning vinyl polymer with pendant —$CO_2H$ groups having a molecular weight of about 500–15,000;
(3) about 0.3–14% of a phosphinopolycarboxylic soil dispersing agent and having a molecular weight of about 200–5,000; and
(4) about 0.5–18% of a water-conditioning organic phosphonate monomer; and
(b) contacting said aqueous wash solution of (a) with said soiled surface for a period of time effective to clean said soiled surface.

27. The process of claim 26 wherein said detergent composition is in cast solid, powder, or granulated form.

28. The process of claim 26 wherein said detergent composition is an aqueous liquid, gel, or mull.

29. The process of claim 26 wherein said source of alkalinity comprises alkali metal hydroxides or alkali metal silicates.

30. The process of claim 26 wherein said alkali metal hydroxide comprises sodium hydroxide, potassium hydroxide, or mixtures thereof.

31. The process of claim 26 wherein said alkali metal silicate comprises sodium metasilicate.

32. The process of claim 30 wherein said sodium hydroxide comprises about 30–50% of sodium and about 10–30% of 0.50 wt-% aqueous sodium hydroxide.

33. The process of claim 26 wherein said vinyl polymer comprises acrylic polymers or polymaleic anhydrides.

34. The process of claim 26 wherein said acrylic polymer comprises sodium polyacrylate, polyacrylic acid, the partial sodium salt of polyacrylic acid or mixtures thereof having a molecular weight of about 750–10,000.

35. The process of claim 34 wherein said sodium polyacrylate has a molecular weight of about 1000–6000.

36. The process of claim 26 wherein said organic phosphonate is 1-hydroxyethylidene-1,1-diphosphonic acid.

37. The process of claim 26 wherein said detergent composition has a zero phosphate content.

38. The process of claim 26 wherein said aqueous wash solution is applied to said soiled surface at about 50°–75° C.

39. The process of claim 26 wherein said detergent composition further comprises:

(a) about 5–75% of distilled water; and (b) about 1–5% of a nonionic surfactant

40. The process of claim 26 wherein said detergent composition further comprises about 5–20% sodium chloride or sodium sulfate.

41. The process of claim 26 wherein said detergent composition further comprises about 1–15% of an active chlorine source.

42. The process of claim 41 wherein said chlorine source comprises sodium hypochlorite, calcium hypochlorite, or sodium dichloroisocyanurate dihydrate.

* * * * *

UNITED STATES PATENT AND TRADEMARK OFFICE

CERTIFICATE OF CORRECTION

PATENT NO. : 4,846,993

DATED : July 11, 1989

INVENTOR(S) : STEVEN E. LENTSCH et al.

It is certified that error appears in the above-identified patent and that said Letters Patent is hereby corrected as shown below:

Column 4, line 53, for "33:1" read --3:1--.
Column 5, line 63, for "about carbon" read --about 4 carbon--.

Column 7, line 3 for "$PO^3_4$" read --$PO_4^{3-}$--.

Column 9, line 10, for "10 5 or 11 5" read --10.5 or 11.5--.
Column 9, the headings in Table II at lines 35-39 should read as follows:

--

| Test No. | Deq. 2010 PPM | LMW 45 PPM | Belsp. 161 PPM | Carbonate PPM | Ca PPM | Mg PPM | Na PPM | pH After 2 Hours @70 C. |
|---|---|---|---|---|---|---|---|---|

--

Column 11, line 59, for "Limiting" read --Liming--.
Column 14, lines 37-38, for "phosphinopolycarboxylic soil" read --phosphinopolycarboxylic acid effective as a soil--.
Column 14, line 60, for "sodium and" read --sodium hydroxide beads and--.

Signed and Sealed this

Thirteenth Day of February, 1990

*Attest:*

JEFFREY M. SAMUELS

*Attesting Officer* *Acting Commissioner of Patents and Trademarks*